US006264519B1

(12) United States Patent
Brown

(10) Patent No.: US 6,264,519 B1
(45) Date of Patent: Jul. 24, 2001

(54) AQUATIC PROPULSION DEVICE

(76) Inventor: William B. Brown, 218 Jo Dr., Los Gatos, CA (US) 95032

( * ) Notice: Subject to any disclaimer, the term of this patent is extended or adjusted under 35 U.S.C. 154(b) by 0 days.

(21) Appl. No.: 09/514,575

(22) Filed: Feb. 28, 2000

(51) Int. Cl.[7] ..... A63B 31/00

(52) U.S. Cl. ..... 441/55; 440/101; 440/104; 441/56

(58) Field of Search ..... 440/21, 101, 102, 440/103, 104; 441/55–58, 59, 129, 136, 80, 88

(56) References Cited

U.S. PATENT DOCUMENTS 356,846 * 2/1887 Martin ..... 440/104
1,894,874 * 1/1933 Kask ..... 441/56
5,387,143 * 2/1995 Pitman ..... 440/101
6,022,255 * 2/2000 Lukanovich ..... 440/101

FOREIGN PATENT DOCUMENTS

123262 * 5/1927 (CH) ..... 440/104
19768 * 1/1898 (GB) ..... 440/55

* cited by examiner

*Primary Examiner*—Ed Swinehart

(57) ABSTRACT

According to one aspect of the invention an aquatic propulsion device is provided comprising a harness to be worn on the body of a person, at least a first elongate member, and at least a first paddle. The first elongate member has first and second opposed ends and a first grip. The first end is pivotally securable to the harness. The first paddle is secured to the second end of the first elongate member. The first grip is positioned so that a person, when wearing the harness, can reach and hold onto the grip with a first hand and move the first grip so that the first elongate member and the first paddle pivot relative to the harness.

21 Claims, 18 Drawing Sheets

AQUATIC PROPULSION DEVICE

BACKGROUND OF THE INVENTION

1). Field of the Invention

This invention relates to an aquatic propulsion device.

2). Discussion of Related Art

Human powered aquatic propulsion devices are often used for purposes of sport, recreation, fishing, rescue or rehabilitation. Aquatic propulsion devices come in different configurations, some relying on primarily lower body strength and others on upper body strength. An aquatic propulsion device that relies on upper body strength often utilizes paddles for propulsion. Aquatic propulsion devices utilizing paddles are described in U.S. Pat. Nos. 5,114,371, 4,302,194, 5,348,503, and 5,649,845. Some aquatic propulsion devices utilize hand paddles such as described in U.S. Pat. Nos. 3,922,740, 5,658,224, and 5,288,254. More complex configurations are described in U.S. Pat. Nos. 3,800,734 and 4,472,147.

SUMMARY OF THE INVENTION

According to one aspect of the invention, an aquatic propulsion device is provided comprising a harness to be worn on the body of a person, at least a first elongate member, and at least a first paddle. The first elongate member has a first and second opposed ends. The first end is pivotally securable to the harness. The first paddle is secured to the second end of the first elongate member. A combination of the first elongate member and the first paddle has a first grip positioned so that the person, when wearing the harness, can reach and hold onto the first grip with a first hand and move the first grip so that the first elongate member and the first paddle pivot relative to the harness. The first grip may be located on the first elongate member or on the paddle.

BRIEF DESCRIPTION OF THE DRAWINGS

The invention is further described by way of examples with reference to the accompanying drawings.

DETAILED DESCRIPTION OF THE INVENTION

Figure 1:
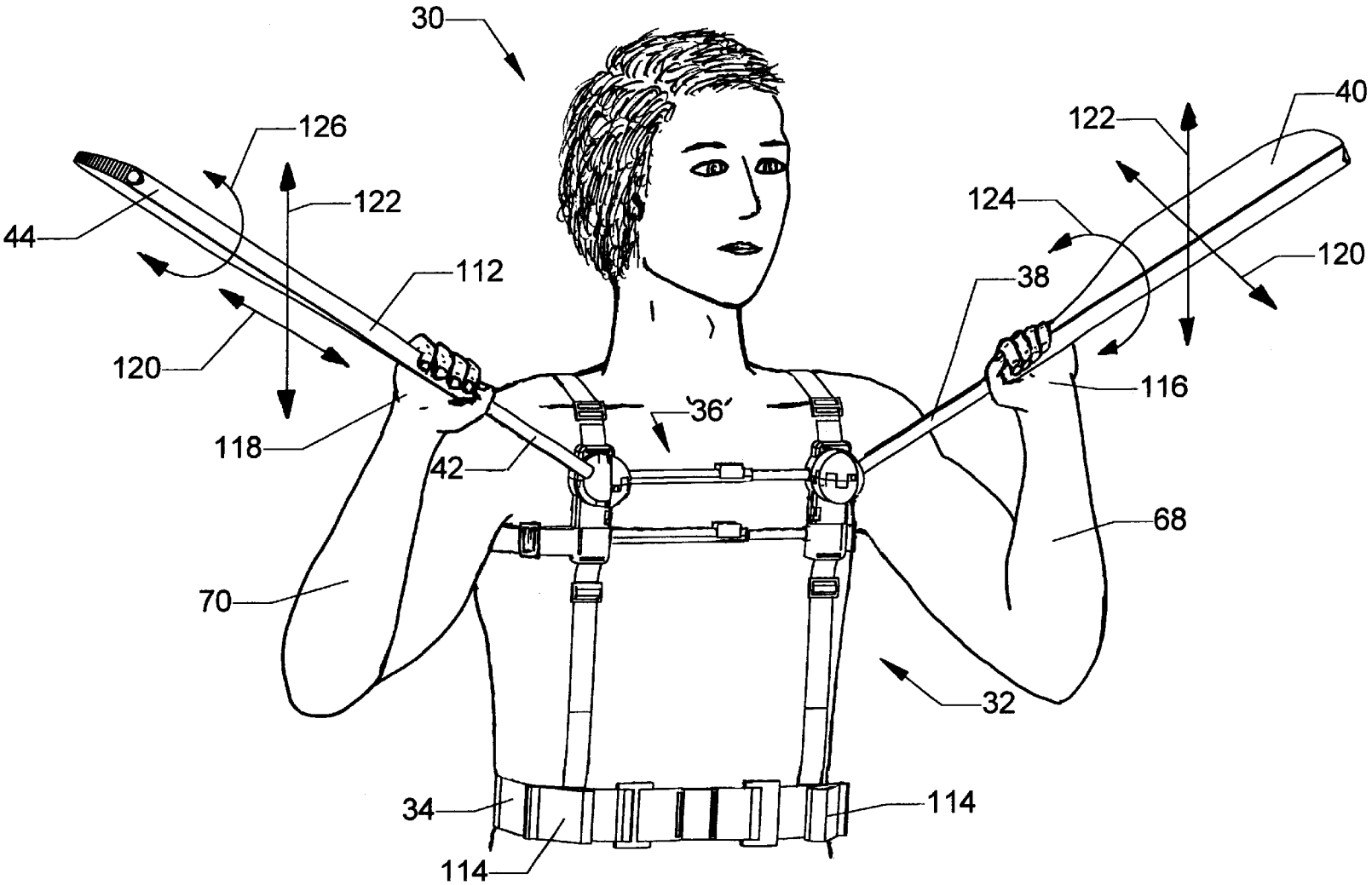
FIG. 1 is a perspective view of a person wearing an aquatic propulsion device according to one embodiment of the invention.

FIG. 1 of the accompanying drawings illustrates a person 30 wearing an aquatic propulsion device 32 according to an embodiment of the invention. The aquatic propulsion device 32 includes a harness 34, a rigid chest structure 36, a left elongate shaft 38, a left paddle 40, a right elongate shaft 42, and a right paddle 44.

Figure 2:
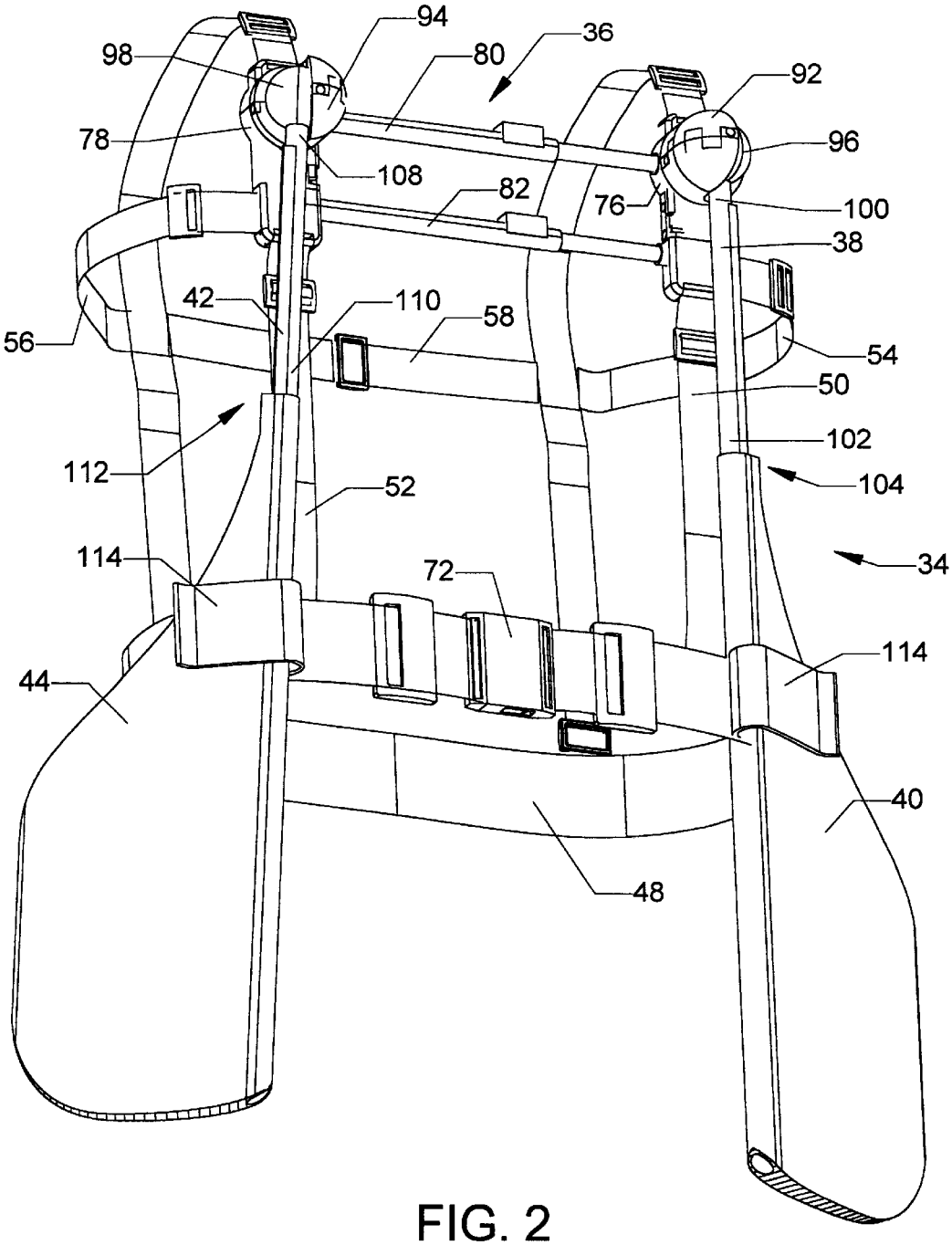
FIG. 2 is a perspective view of the aquatic propulsion device.

Referring to FIG. 2, the harness 34 includes a belt 48, a left shoulder strap 50, a right shoulder strap 52, a left underarm strap 54, a right underarm strap 56, and a back strap 58. Opposing ends of the left shoulder strap 50 are secured to the belt 48 and opposing ends of the right shoulder strap 52 are secured to the belt 48. Opposing ends of the left underarm strap 54 are secured to the left shoulder strap 50 and opposing ends of the right underarm strap 56 are secured to the right shoulder strap 52. One end of the back strap 58 is secured to the left shoulder strap 50 and an opposing end of the back strap 58 is secured to the right shoulder strap 52.

In use, the person 30 shown in FIG. 1 inserts a left arm 68 through an opening formed by the left underarm strap 54 and the left shoulder strap 50 and a right arm 70 through an opening formed by the right underarm strap 56 and the right shoulder strap 52. The back strap 58 is then located across the back of a person 30. The belt 48 is positioned around a waist of the person 30 and opposing ends of the belt 48 are secured to one another with a buckle 72. The harness 34 is thereby secured to a torso of the person 30. The harness straps and belt 48, 50, 52, 54, 56, and 58 are all adjustable for comfort and fit.

The rigid chest structure 36 includes left and right harness mounts 76 and 78 and upper and lower links 80 and 82. The left and right harness mounts 76 and 78 are secured to the left and right shoulder straps 50 and 52 respectively. The left harness mount 76 is secured to a left end of the upper link 80 and a left end of the lower link 82. The left ends of the links 80 and 82 may be screwed into the left harness mount 76, may be welded to the left harness mount 76, or otherwise secured to the left harness mount 76 so as to provide rigidity which prevents forward or backward pivoting of the left harness mount 76. The right harness mount 78 may be secured to right ends of the upper and lower links 80 and 82 in a similar manner so that backward and forward pivoting of the right harness mount 78 relative to the upper and lower links 80 and 82 is prevented. Pivoting of the harness mounts 76 and 78 relative to one another is also prevented due to rigidity of the upper and lower links 80 and 82 themselves.

A left elongate member mount socket 92 is secured to the left harness mount 76 and a right elongate member socket 94 is secured to the right harness mount 78. Each elongate mount socket 92 or 94 has a spherical inner surface into which a respective ball 96 or 98 is located. The left elongate shaft 38 has a first end 100 secured to the ball 96. The paddle 40 is secured to a second end 102 of the second elongate shaft 38 opposing the first end 100. A section of the left elongate shaft 38 between the ball 96 and the second end 102 and together with the paddle 40 provides a left grip 104 for holding onto. Similarly, the right elongate shaft 42 has a first end 108 secured to the ball 98. The right paddle 44 is secured to a second end 110 of the right elongate shaft 42 opposing the first end 108. The right elongate shaft 42 has a section between the ball 98 and the second end 110 which together with the paddle 44 provide a right grip 112 for holding onto.

The elongate shafts 38 and 42 and the paddles 40 and 44 are initially located in a storage position as shown in FIG. 2. In such a position the elongate shafts 38 and 42 extend along the length of the body of the person 30 towards her feet. The paddles 40 and 44 are located flat against her thighs. Channel shaped clips 114 are secured to the belt 48. Each paddle 40 or 44 is inserted into a respective clip 114 and is retained by the clip 114 due to spring action which tends to close the clip 114.

The person 30 can then remove the paddles 40 and 44 from the clips 114 and, while standing up, can pivot the elongate shafts 38 and 42 upwardly. The left grip 104 is located in a position so that the person 30 can reach and hold onto the left grip 104 with a left hand 116. The person can also reach and hold onto the right grip 112 with a right hand 118. The person can then move the grips 104 and 112, and therefore the elongate shafts 38 and 42, independently from one another. Movement of the elongate shafts 38 and 42 cause movement of the paddles 40 and 44. Due to the ball mount of the elongate members 38 and 42, the paddles 40 and 44 are movable in a number of different directions or combinations of directions. For example, each paddle 40 or 44 is movable in a backward or forward direction 120. Each paddle 40 or 44 is also movable in an upward or downward direction 122. The ball mount also allows for the left shaft 38 to be rotated in a direction 124 about an axis in which the elongate member 38 extends, with corresponding movement of the paddle 40. Similarly, the right elongate shaft 42 can be rotated in a direction 126 with corresponding movement of the right paddle 44. Movement of, for example, the grip left 104 with a certain force results in more movement of the paddle 40 but, possibly, with less force. Movement in the directions 120, 122, 124, and 126 can be combined in a number of ways to provide aquatic propulsion. Some ways of creating aquatic propulsion are now described with reference to FIG. 3 to FIG. 6.

Figure 3:
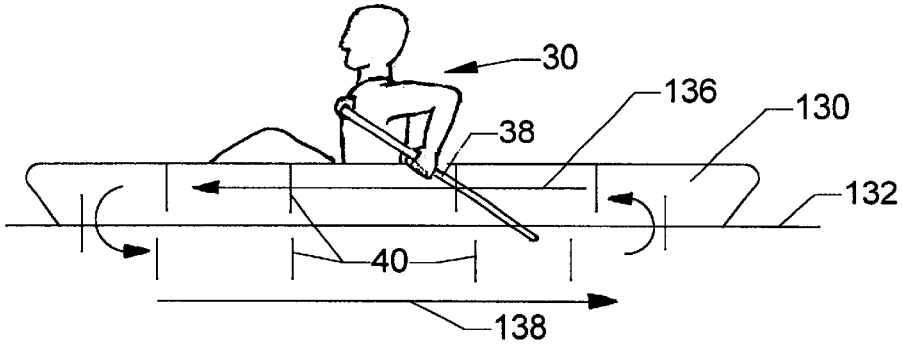
FIG. 3 is a side view illustrating how a person can use the aquatic propulsion device for propelling a boat.

In FIG. 3 the person 30 is shown sitting in a boat 130 floating on water 132. The person 30 is located with her torso in an upright position. The left elongate shaft 38 is sufficiently long so that the left paddle 40 can reach over an edge of the boat 130 into the water 132. The person 30 can move the paddles 40 and 44 in an orbital path to ensure continued propulsion. During one section of the orbital path the paddle 40 is moved in a forward direction 136 over a surface of the water 132. No propulsion occurs when the paddle 40 is moved over the surface of the water 132 in the forward direction 136. The paddle 40 is then inserted into the water and then, in another section of the orbital path, the paddle 40 is moved in a backward direction 138 through the water 132. The paddle is then lifted out of the water 132 and is then again moved in the forward direction 136. The boat 130 is propelled in a forward direction when the paddle 40 is moved in the backward direction 138.

Figure 4:
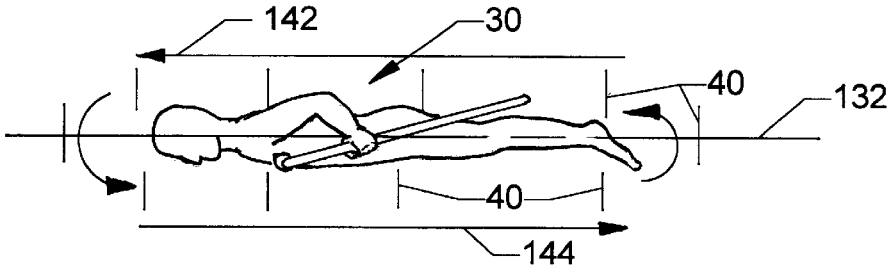
FIG. 4 is a side view illustrating how a person can use the aquatic propulsion device for propulsion through water by moving a paddle in an orbital path over and through the water.

In FIG. 4 the person 30 is located horizontally in water 132 and facing down. The person moves the paddle 40 in an orbital path wherein the paddle 40 moves in a forward direction 142 over the surface of the water 132, and in a backward direction 144 through the water. The person 30 is propelled lengthwise through the water 132 while the paddle 40 moves in the backward direction 144. No propulsion occurs when the paddle 40 is moved in the forward direction 142 over the surface of the water 132.

Figure 5:
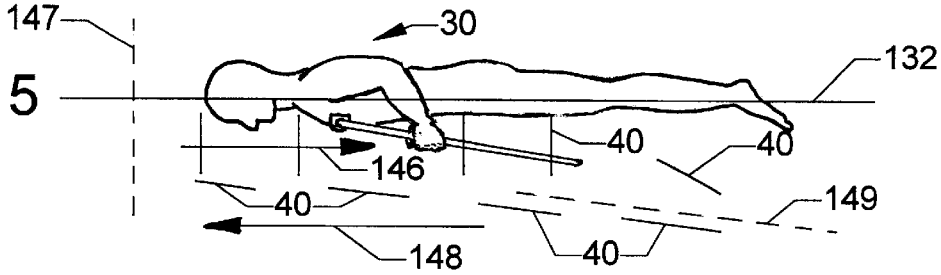
FIG. 5 is a side view illustrating how a person can use the aquatic propulsion device for propulsion through water by moving a paddle backwards and forwards through water.

In the example illustrated in FIG. 3 and FIG. 4 there is no need for rotation of the paddle 40 to ensure propulsion. FIG. 5 now illustrates one example wherein rotation of the paddle 40 is necessary to ensure propulsion. The person 30 is again located in a horizontal position floating on or under water 132. The person moves the paddle 40 in a backward direction 146. The paddle 40 is in a plane 147 which is transverse to the backward direction 146, thus ensuring that the person 30 is propelled lengthwise through the water 132. The paddle 40 is then rotated so that it is in a plane which is at a smaller angle with a surface of the water 132 than when it is moved in the backward direction 146, and is preferably in a plane 149 which is substantially horizontal, and is then moved in a forward direction 148 through the water 132. Because of the angle of the paddle 40, relatively little backward propulsion results due to movement of the paddle 40 in the forward direction 148. The resultant of movement of the paddle 40 in the backward direction 146 and in the forward direction 148 cause forward propulsion of the person 30 through the water 132.

Figure 6:
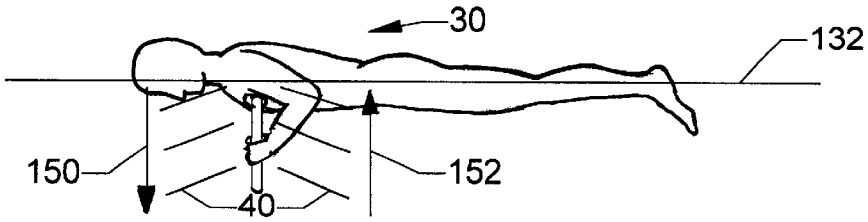
FIG. 6 is a side view illustrating how a person can use the aquatic propulsion device for propulsion through water by up and down movement of a paddle.

FIG. 6 illustrates another example wherein rotation of the paddle 40 may be necessary. The person 30 is again located horizontally floating on or under water 132. The person 30 pushes the paddle 40 in a downward direction 150 while the paddle 40 is rotated so that a front edge of the paddle is lower than a back edge of the paddle 40. Such movement causes forward propulsion of the person 30 through the water 132. The person 30 then rotates the paddle 40 so that the front edge of the paddle 40 is higher than the back edge of the paddle 40 and then pulls the paddle 40 in an upward direction 152. Such movement of the paddle 40 again causes forward propulsion of the person 30 through the water 132. It is believed that continuous movement in the downward direction 150 and the upward direction 152 may be a very efficient manner of propelling the person 30 through the water 132 because of the continuous nature of propulsion.

Although only one side of the person 30 is shown and only the left elongate shaft 38 and the left paddle 40, it should be understood that the right elongate shaft 42 and the right paddle 44 move simultaneously with the left elongate shaft 38 and the left paddle 40 in exactly the same manner. For example, although only the left paddle 40 is shown moving in the downward direction 150, it should be understood that the right paddle 44 moves simultaneously with the left paddle 40 in a downward direction 150. The right paddle 44 then returns with the left paddle 40 in an upward direction. Any movement on the left of the person 30 is thus mirrored by simultaneous movement on the right of the person 30.

The left and right paddles 40 and 44 can also move independently from one another. Variations of movement and rotation between the left paddle 40 and the right paddle 44 can be used to turn or otherwise maneuver a person 30 in the water 132.

In FIG. 4 to FIG. 6 other propulsion devices may be used such as foot fins for creating additional propulsion or for augmenting the movements described.

Figure 7:
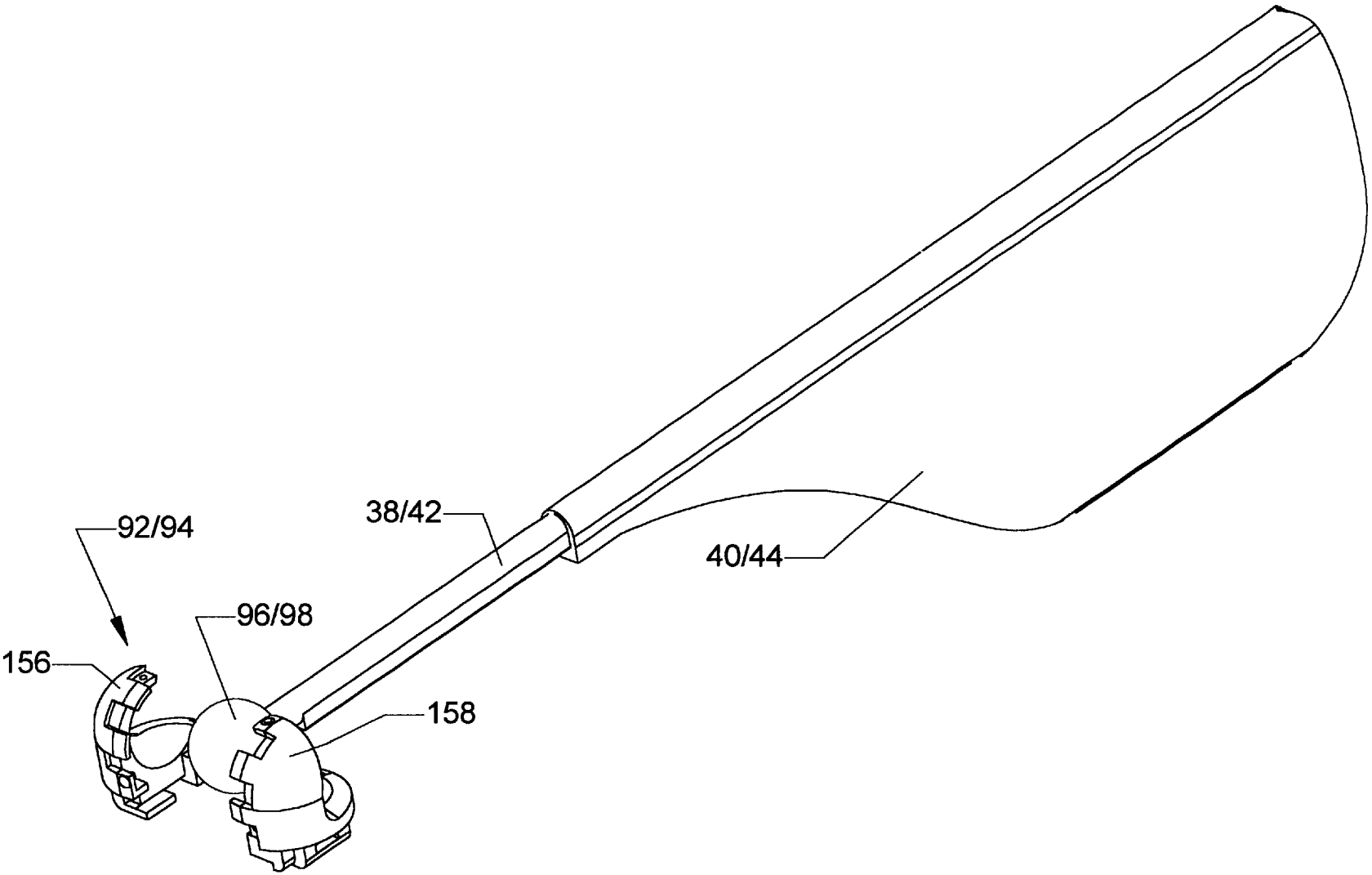
FIG. 7 is a perspective view illustrating an elongate member mount socket in exploded form.
Figure 8:
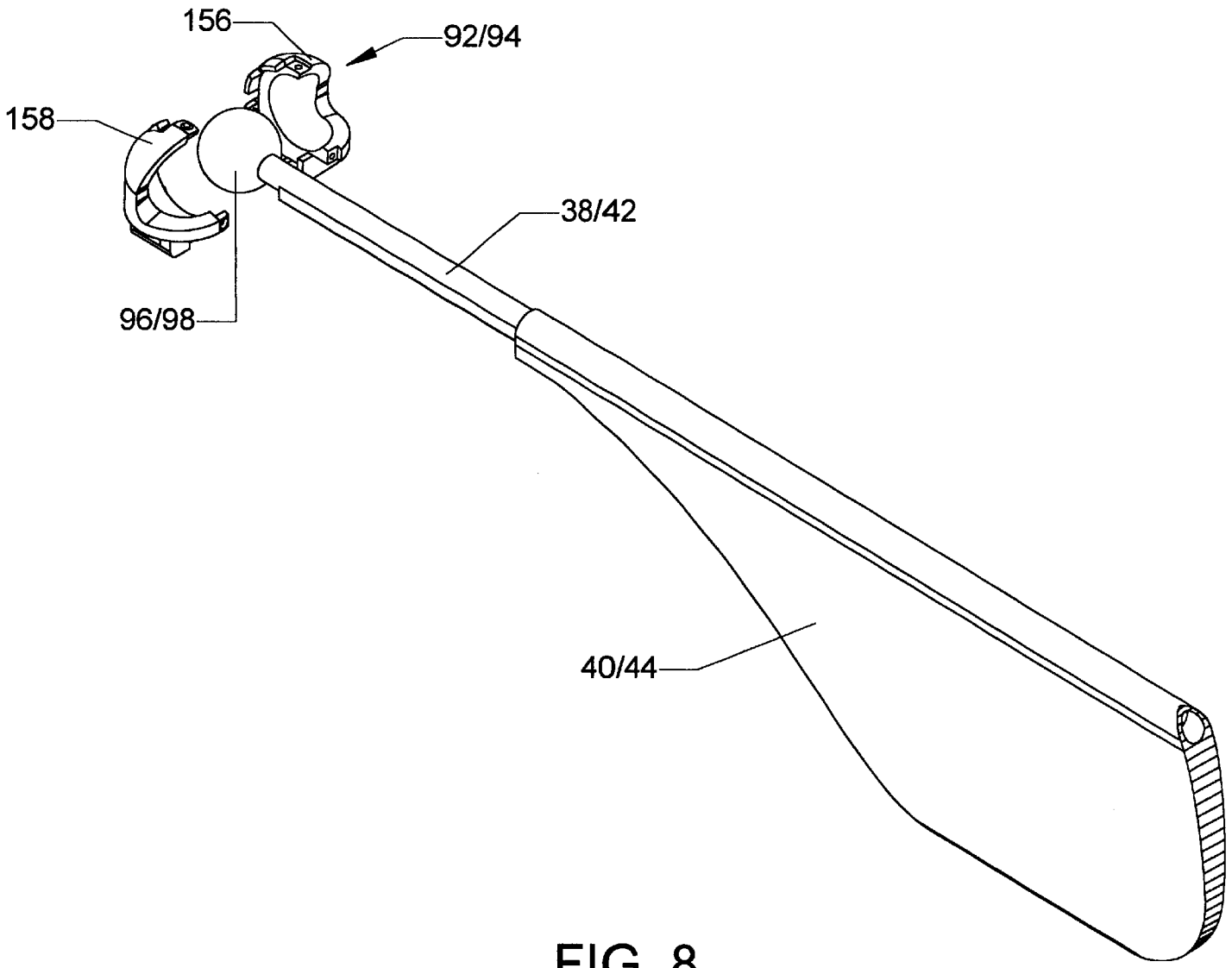
FIG. 8 is a perspective view similar to FIG. 7 but from a different angle.

FIG. 7 and FIG. 8 illustrate one of the elongate member mount sockets 92 or 94 before one of the balls 96 or 98 is secured thereto. The elongate member mount socket 92 or 94 includes two halves 156 and 158. Each half 156 and 158 has an inner surface defining a portion of a sphere. The two halves 156 and 158 are located over the ball 96 or 98 and secured to one another with fasteners such as screws, bolts, nuts or the like, or with welding or otherwise. Once the halves 156 and 158 are secured to one another, the ball 96 or 98 is not removable from the halves 156 and 158.

Figure 9:
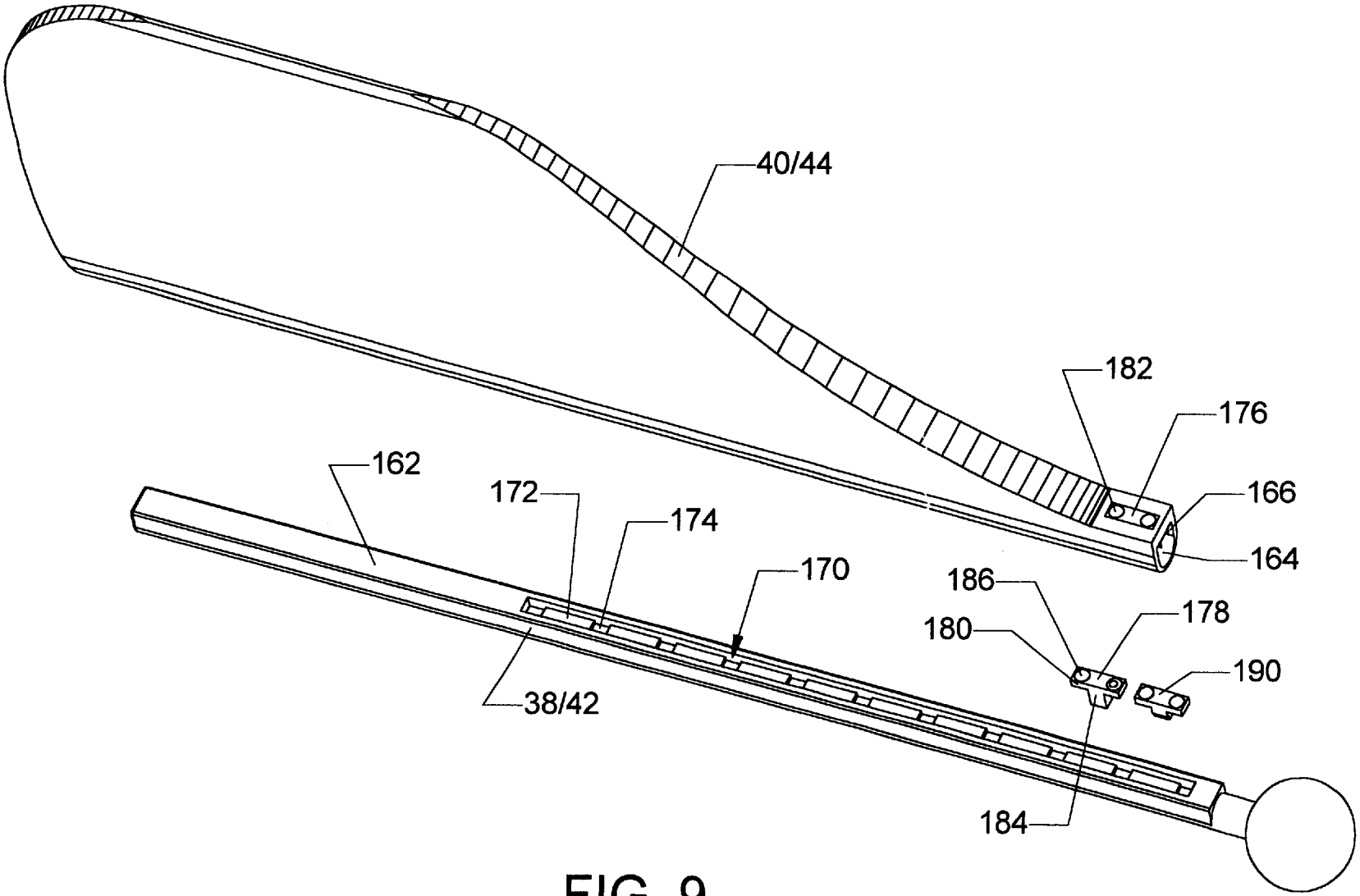
FIG. 9 is a perspective view of an elongate shaft and a paddle forming part of the aquatic propulsion device, illustrating features for adjusting and locking the paddle at a selected position along a length of the elongate shaft.

It may in certain instances be necessary to adjust the distance of the paddles 40 or 44 from the harness 34. Such a feature may for example be necessary when the user moves between using the aquatic propulsion device 32 in any one of the modes as illustrated in any one of FIG. 4 to FIG. 6 to a mode as illustrated in FIG. 3 and it may be required that the paddle 40 be located further from the harness 34. Another reason for adjusting one of the paddles 40 or 44 relative to the harness 34 is to obtain optimal speed or force of the paddle 40 or 44 through the water. FIG. 9 illustrates how one of the paddles 40 or 44 is adjustable relative to one of the elongate shafts 38 or 42.

As illustrated in FIG. 9, the elongate shaft 38 or 42 has one surface 162 which is substantially flat. The paddle 40 or 44 has an opening 164 formed therein with one side 166 which is substantially flat. The second end 102 or 110 of the elongate shaft 38 or 42 is insertable into the opening 164 with the surface 162 against the side 166. Due to complementary cross sections of the opening 164 and the elongate shaft 38 or 42, rotation of the paddle 40 or 44 about an elongate axis of the elongate shaft 38 or 42 is prevented. The paddle 40 or 44 is however slidably movable along the length of the elongate shaft 38 or 42 and is movable by hand. By first sliding the paddle 40 or 44 along the length of the elongate shaft 38 or 42, the distance of the paddle 40 or 44 can be adjusted towards or away from the harness 34. Such sliding movement may be unrestricted in the sense that a person can slide the paddle 40 or 44 along the elongate shaft 38 or 42 during use of the aquatic propulsion device 32.

In certain instances it may be required that the position of the paddle 40 or 44 along the length of the elongate shaft 38 or 42 be locked. The elongate shaft 38 or 42 has a groove 170 formed therein. A base of the groove 170 is formed by a series of consecutive raised formations 172 and recesses 174. A locking component opening 176 is formed in the paddle 40 or 44 and extends from an outer surface of the paddle 40 or 44 to the opening 164. A locking component 178 is provided for securing the paddle 40 or 44 in a selected position along the length of the elongate shaft 38 or 44. The locking component 178 has shoulders 180 which are located against surfaces 182 of the paddle 40 or 44. The locking component 178 also has a spigot 184 which extends through the opening 176 into the groove 170. The spigot 184 can be located in one of the recesses 174, whereafter the shoulders 180 are secured to the paddle 40 or 44, utilizing fasteners 186 such as screws, bolts, or the like. The spigot 184 thereby prevents movement of the locking component 178, and therefore also the paddle 40 or 44, along the length of the elongate shaft 38 or 42. The spigot 184 can then again be removed from the recess in which it is located, the paddle 40 or 44 can be moved along the length of the elongate shaft 38 or 42, whereafter the spigot 184 can be inserted into another one of the recesses 174 to lock the paddle 40 or 44 in another position along the length of the elongate shaft 38 or 42. The person 30 can then hold onto either the paddles 40 and 44 or the elongate shafts 38 and 42 for purposes of propulsion.

Figure 10:
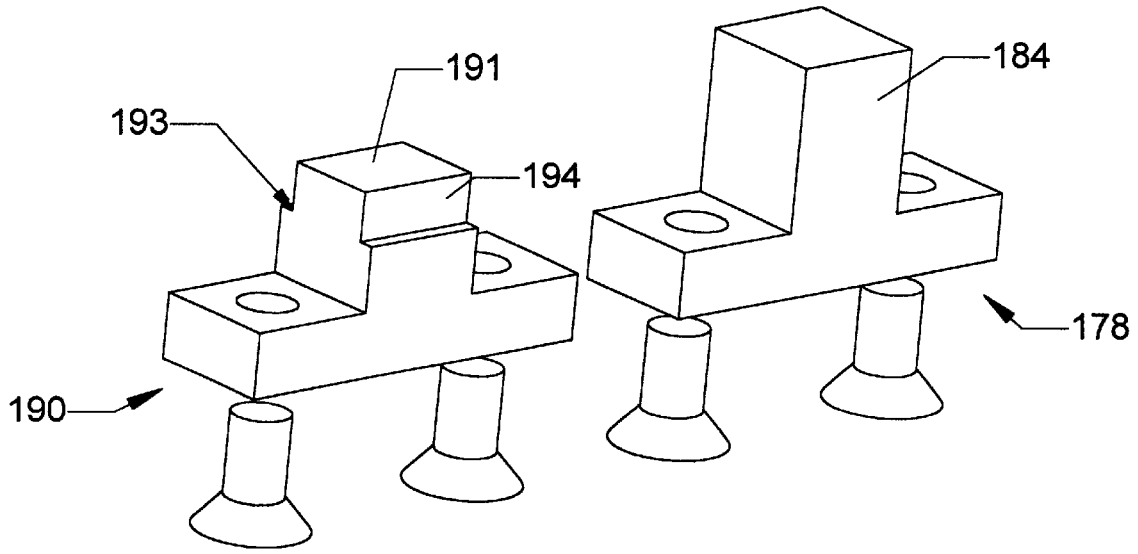
FIG. 10 is a perspective view illustrating a locking component and a sliding component also shown in FIG. 9.
Figure 11:
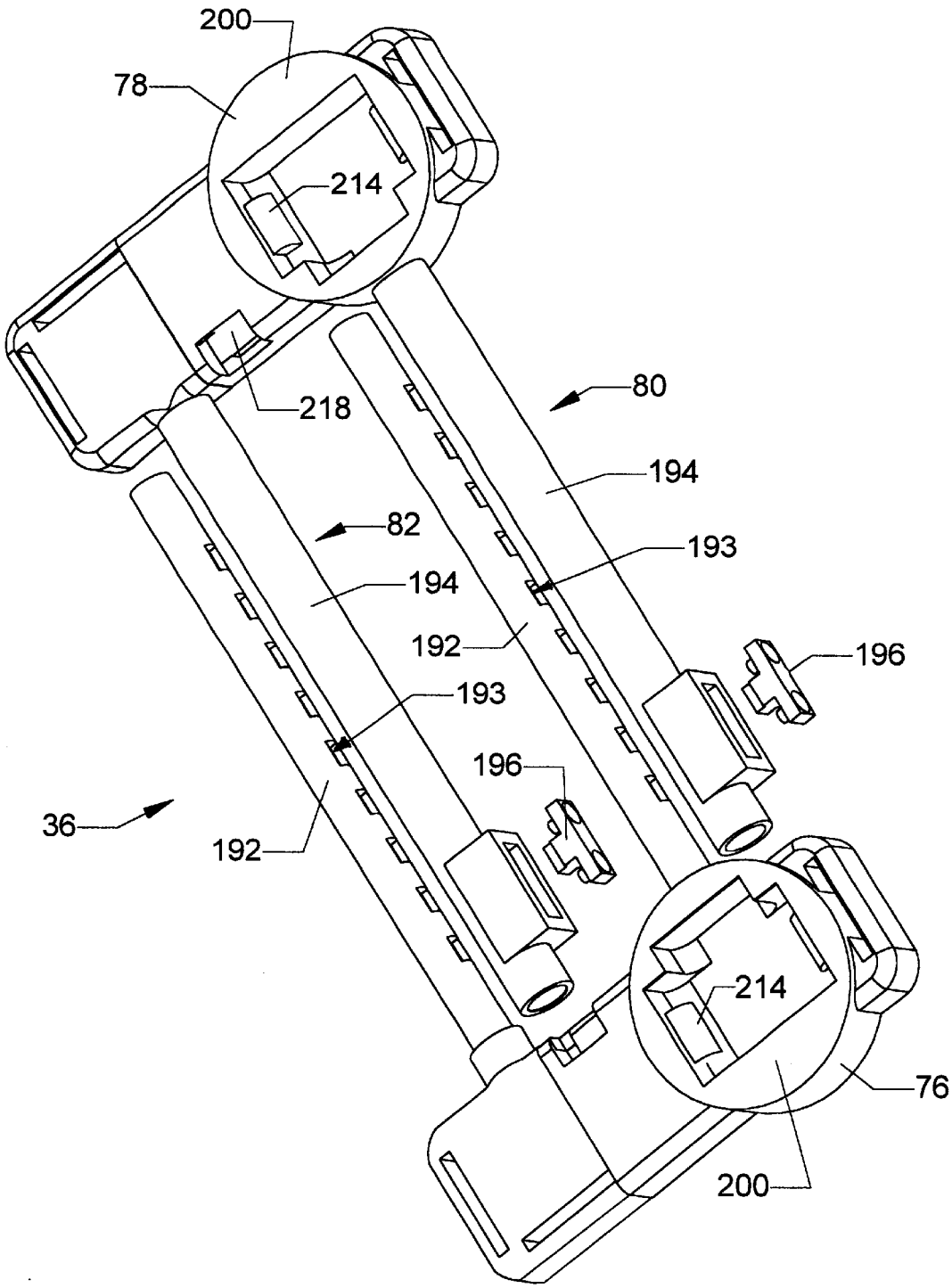
FIG. 11 is a perspective view of a rigid chest structure forming part of the aquatic propulsion device.
Figure 12:
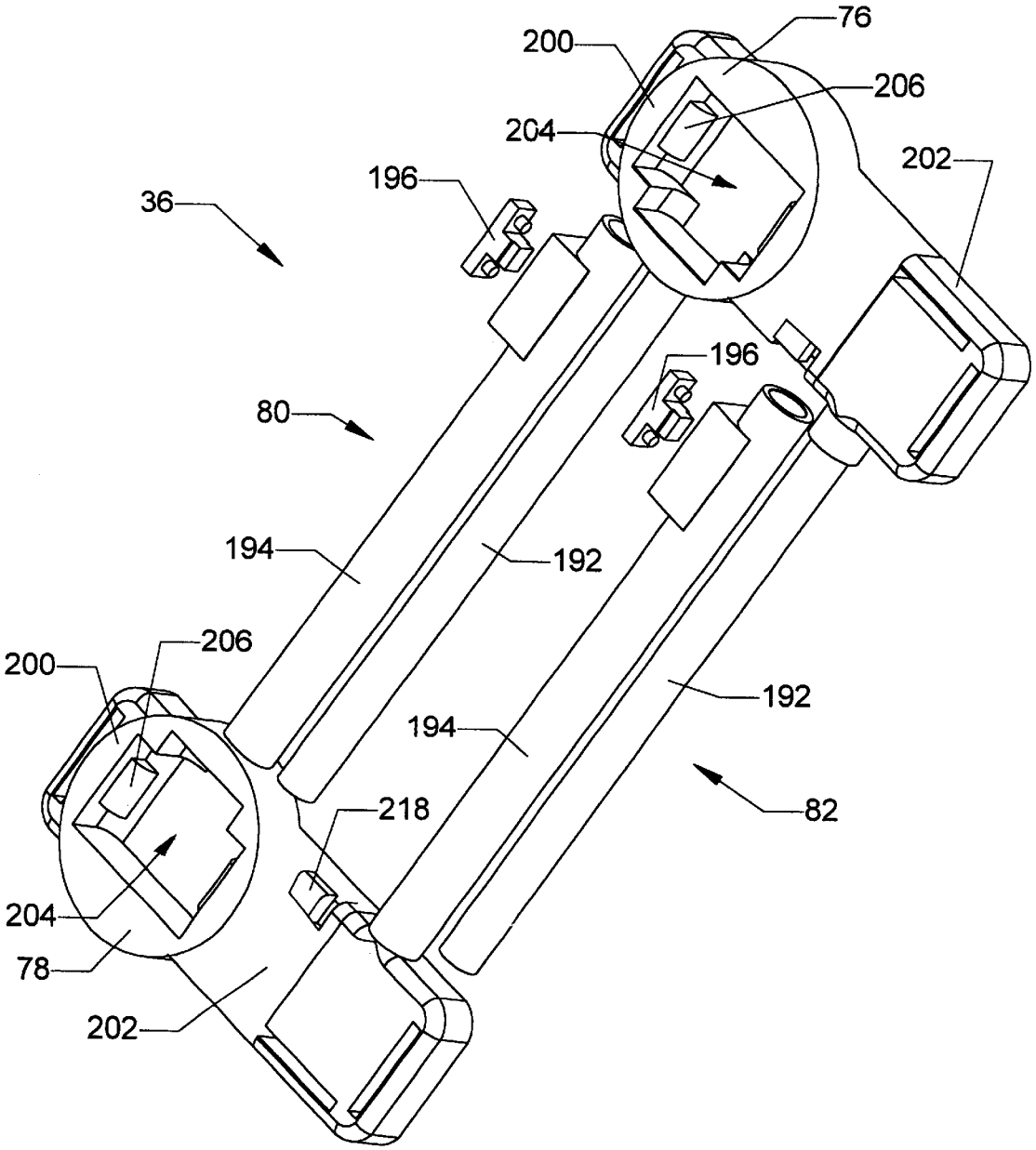
FIG. 12 is a view similar to FIG. 11 but from an opposing side.
Figure 13:
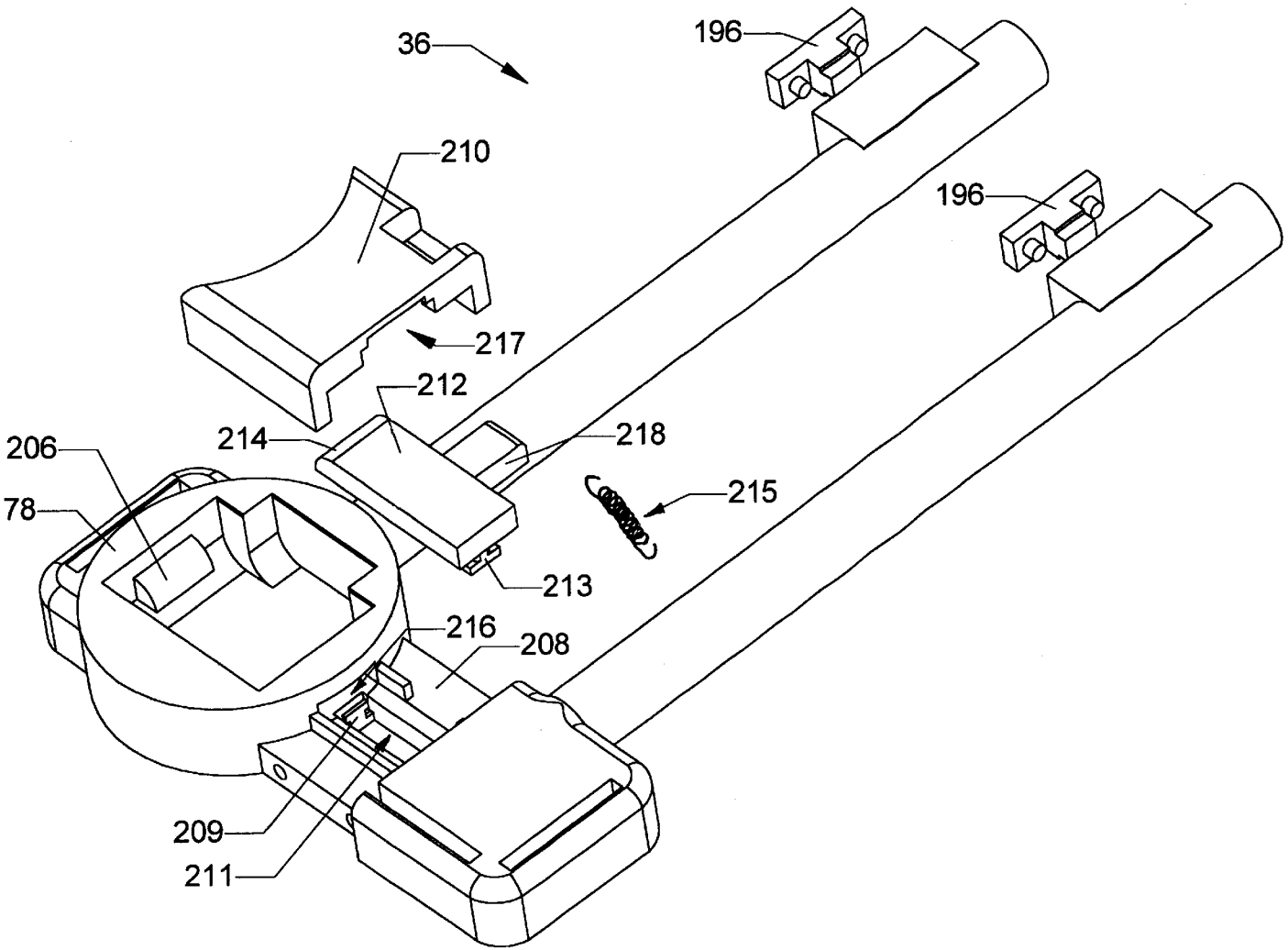
FIG. 13 is a perspective view of a portion of the rigid chest structure in exploded form.
Figure 14:
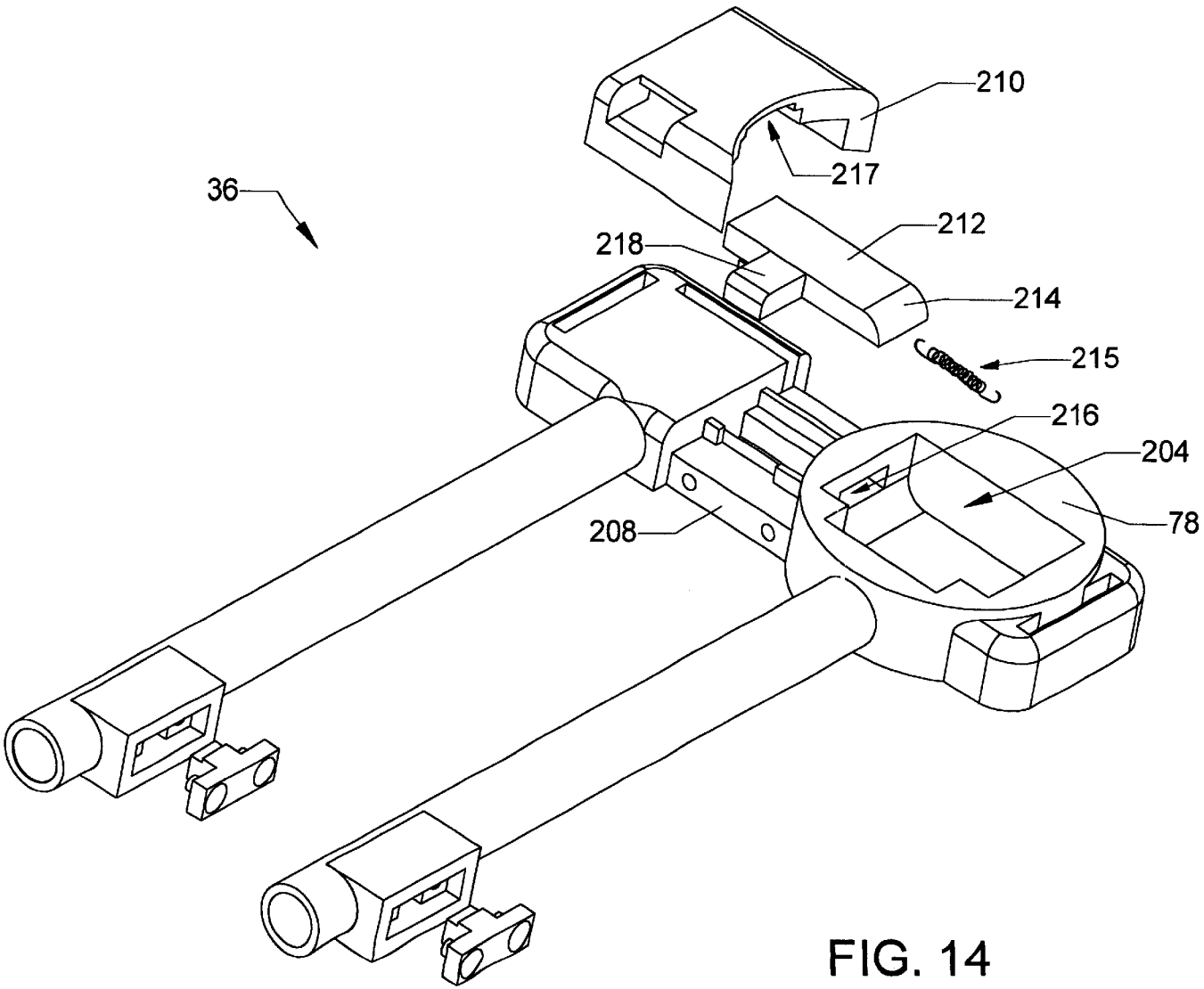
FIG. 14 is a view similar to FIG. 13 but in an opposing side.

The sliding component 190 can be used instead of the locking component 178 to allow for dynamic movement of the paddle 40 or 44 along the length of the elongate shaft 38 or 42. The sliding component 190, when secured to the paddle 40 or 44 has a spigot 191 which extends into the groove 170, but does not extend deeper than the raised formations 172. The sliding component 190 is thereby restricted to movement within the groove 170. This allows the paddle 40 or 44 to dynamically slide its position along elongated shaft 38 or 42, but not inadvertently come off the second end 102 or 110 off the elongated shaft 38 or 42. It may, from time to time, happen that water becomes trapped within a cavity formed by the groove 170 and the side 166. That water is not problematic when the locking component 178 is used and the paddle 40 or 44 is locked into position along the length of the elongate shaft 38 or 42. However, when it is required to adjust the paddle 40 or 44 dynamically, i.e. while being used, along the length of the elongate shaft 38 or 42, a sliding component 190 should allow for the water to escape from such a cavity. FIG. 10 shows the sliding component 190 and the locking component 178 in more detail. The spigot 191 is shorter than the spigot 184 of the locking component 178 to allow for movement of the paddle 40 or 44 along the length of the elongate shaft 38 or 42. In addition, notches 193 and 194 are formed inside of the spigot 191 which allow for water trapped within the cavity to escape when the paddle 40 or 44 is moved along the length of the elongate shaft 38 or 42.

FIG. 11 to FIG. 14 illustrate the rigid chest structure 36 in more detail. The upper link and the lower link 80 and 82 each include a round left link section 192 and a tubular right link section 194. The left link section 192 is insertable into the right link section 194 and can be adjusted so as to adjust the spacing between the left and right harness mounts 76 and 78. The spacing between the harness mounts 76 and 78 is adjusted for comfort, whereafter the link sections 192 and 194 are locked into position relative to one another by means of a locking component 196. Locking component 196 has a spigot which is inserted through an opening in a side of the right link section 194. The spigot is long enough to extend into recesses 193 in the left link section 192. The locking component 196 can be secured with screw, bolts or the like, to the right link section 194 to prevent movement of the right link section 194 relative to the locking component 196 and therefore relative to the left link section 192.

Each harness mount 76 and 78 includes a respective socket receiving portion 200 and a respective latch holding portion 202. A first key formation 204 is formed from the socket receiving portion 200. A hook 206 is formed on one side surface in the key formation 204.

The latch holding portion 202 includes a chest portion 208 which is secured to the socket receiving portion 200, and a cap 210. When the cap 210 is secured using screws, bolts or the like, to the chest portion 208, a latch cavity 217 is defined between surfaces of the chest portion 208 and the cap 210. Before securing the cap 210 to the chest portion 208, a latch member 212 is then located on the chest portion 208. The latch member 212 has a latch hook 214 which extends through an opening 216 into the first key formation 204. The latch member 212 is slidably movable so that the latch hook 214 can move out of and back into the first key formation 204. Chest portion 208 has a chest spring attachment 209 in a recessed spring channel 211. Latch member 212 has a latch member spring attachment 213 extending below it into the recessed spring channel 211. A contracting latch spring 215 is extended against a spring force thereof and opposing ends thereof are attached to the chest spring attachment 209 and the latch member spring attachment 213 respectively. The contracting latch spring 215 fits unencumbered into recessed spring channel 211. The natural contraction of the spring 215 biases the latch member 212 in a direction wherein the latch hook 214 is located in the first key formation 204. Once the cap 210 is secured to the chest portion 208, the latch member 212 is secured within the latch holding portion 202. A finger 218 extends from the latch member 212 out of the latch holding portion 202. The finger 218 can be moved so that the latch hook 214 can be moved out of the key formation 204.

Figure 15:
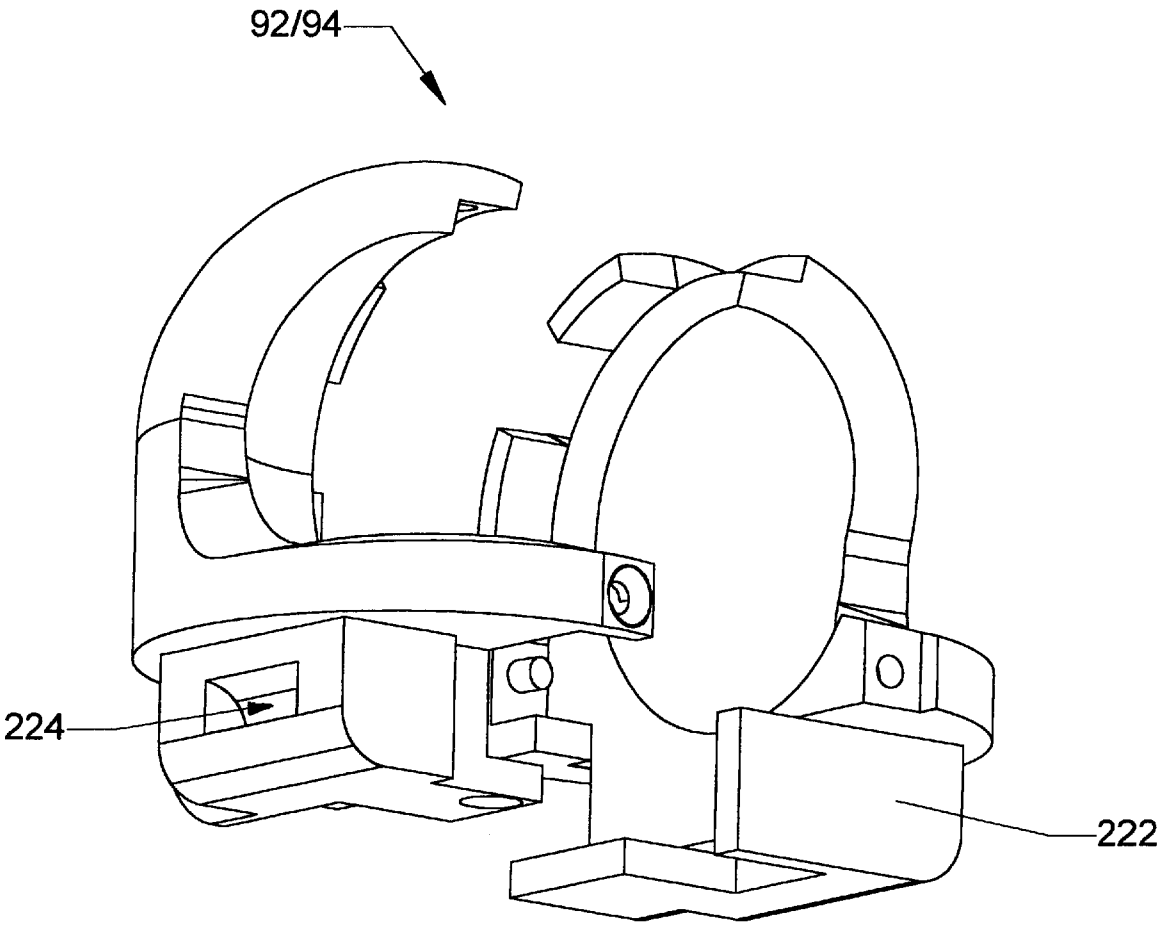
FIG. 15 is a perspective view in exploded form of an elongate member mount socket, in particular illustrating a key formation thereon.

FIG. 15 illustrates one of the elongate member mount sockets 92 or 94 in more detail. The elongate member mount socket 92 or 94 includes a second key formation 222. Hook receiving openings 224 are formed in opposing surfaces of the second key formation 222.

In use, one side of the second key formation 222 is inserted into the first key formation 204 of the socket receiving portion 200 (see FIG. 11 to FIG. 14). The hook 206 is then located in one of the hook receiving openings 224. An opposing side of the second key formation 222 is then pressed against a slanted surface on the latch hook 214 so that the latch member 212 is moved against a contracting action of the spring 215 and the latch hook 214 moves out of the first key formation 204. Once the latch hook 214 is aligned with the hook receiving formation 224 on an opposing side of the hook 206, the latch hook 214 snaps into the hook receiving formation 214. The elongate member mount socket 92 or 94 is thereby secured to the socket receiving portion 200.

The first and second key formations 204 and 222 are complementary to one another. In addition, the second key formation 222 can be inserted into the first key formation 204 in one selected orientation only. Any rotation of the second key formation 222 relative to the first key formation 204 out of the selected orientation is such that the first and second key formation 204 and 222 are not complementary to one another and therefore disallow engagement of the elongate member mount socket 92 or 94 with the socket receiving portion 200. Location of the second key formation 222 by an angle of 180° out of the selected orientation is, in particular, disallowed. Because of the complementary nature of the first and second key formations 204 and 222, it is ensured that the paddles 40 and 44 are always located so as to be capable of extending sideways and away from a person 30. Incorrect attachment is thus avoided.

Figure 16:
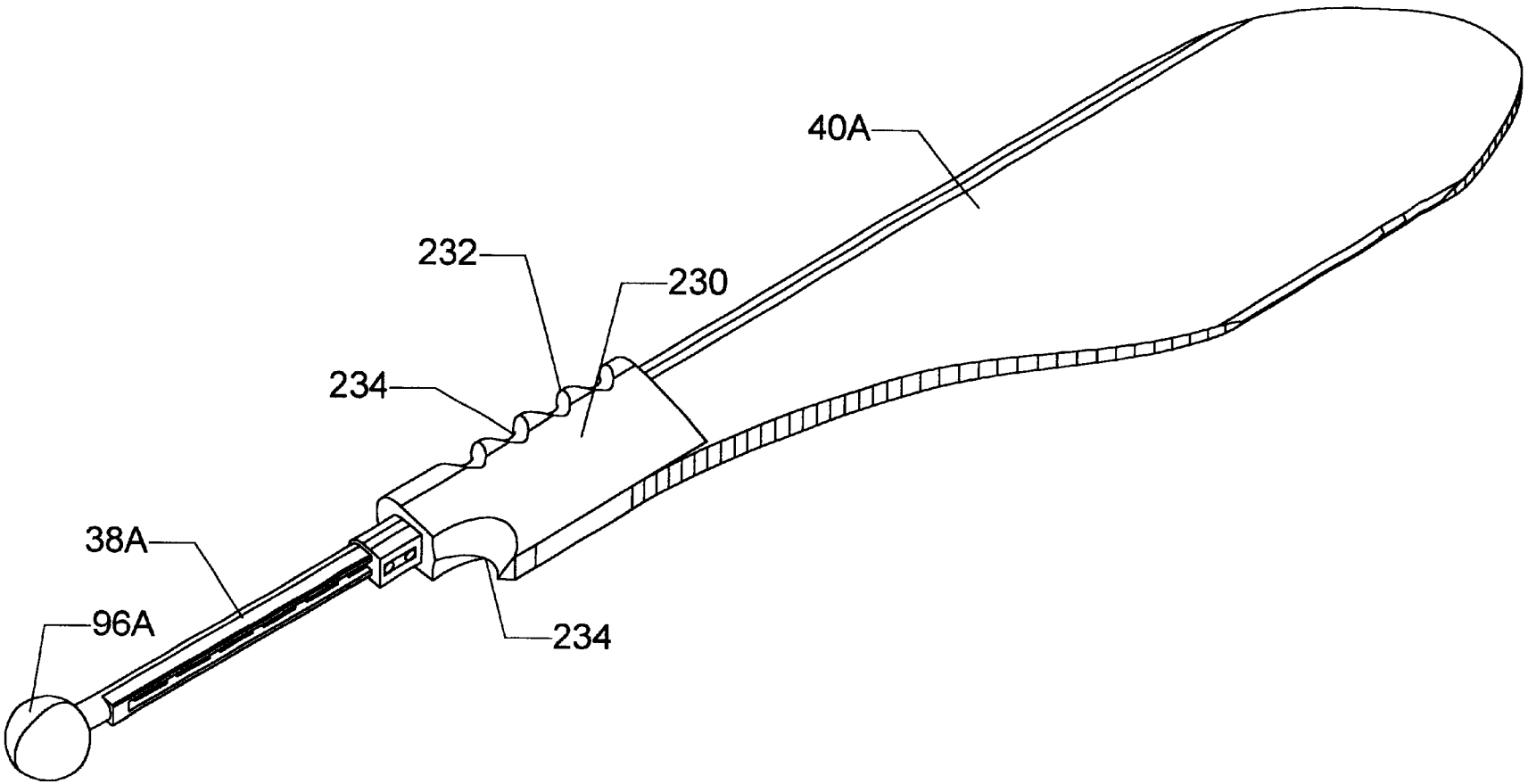
FIG. 16 is a perspective view of components of an aquatic propulsion device according to another embodiment of the invention wherein a handle is provide purposes of rotating a blade.
Figure 17:
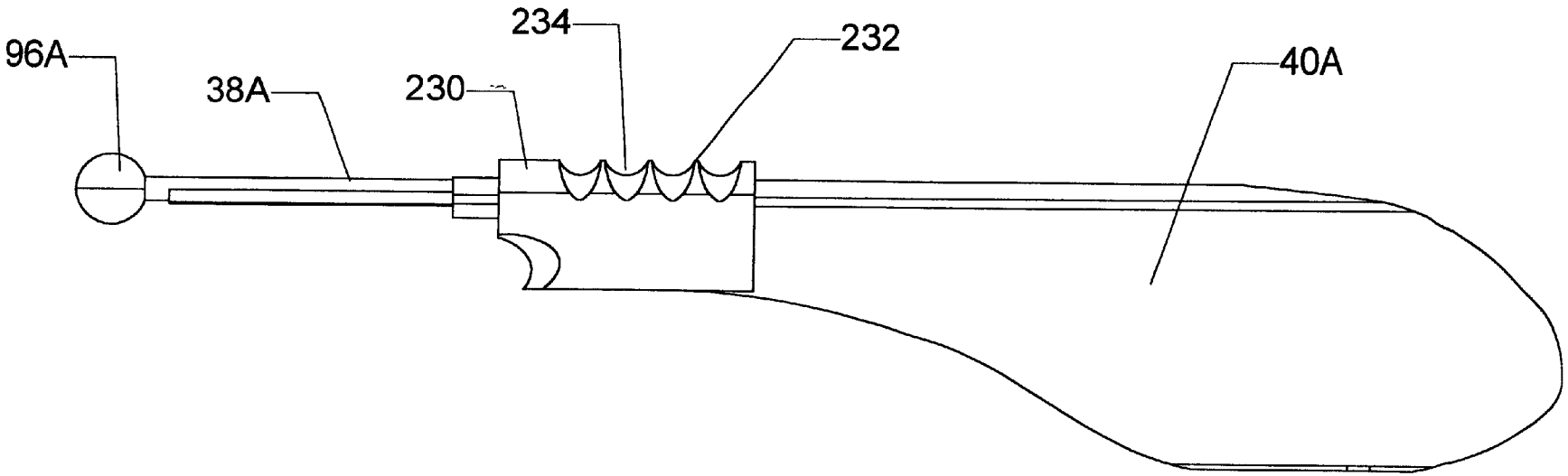
FIG. 17 is a plan view of the components shown in FIG. 16.

Referring again to FIG. 1, the grips 104 and 112 are preferably of the nature which allows the person 30 to exercise a certain degree of torque in the directions 124 and 126. Such torque may be necessary for purposes of stabilizing the paddles 40 and 44 or for rotating the paddles 40 or 44 in water. The elongate shafts 38 and 42 may, for example, be ribbed to provide the necessary grip or may be coated with a substance such as rubber material which can provide a better grip. FIG. 16 and FIG. 17 illustrate another embodiment wherein a handle 230 is slidably located along the length of an elongate shaft 38A having one end secured to a ball 96A. A paddle 40A is secured to the handle 230. The shaft 38A and the handle 230 have cross sections which complement one another to prevent rotation of the handle 230 relative to the elongate shaft 38A. The elongate shaft 38A and the handle 230 together form an elongate member which can be manipulated by a person 30. The handle 230 has a series of raised formations 232 and recesses 234. The raised formations 232 and the recessed formations 234 correspond respectively to recessed formations and raised formations within a person's hand when holding onto the handle 230. A grip formed by the raised formations 232 and the recessed formations 234 allows a person to provide more torque onto the paddle 40A. It should also be noted that the same mechanisms of FIG. 9 and FIG. 10 may be used to fix the handle 230 and the paddle 40A to the elongate shaft 38A or to allow handle 230 and paddle 40A to dynamically slide along a restricted length of elongated shaft 38A.

Figure 18:
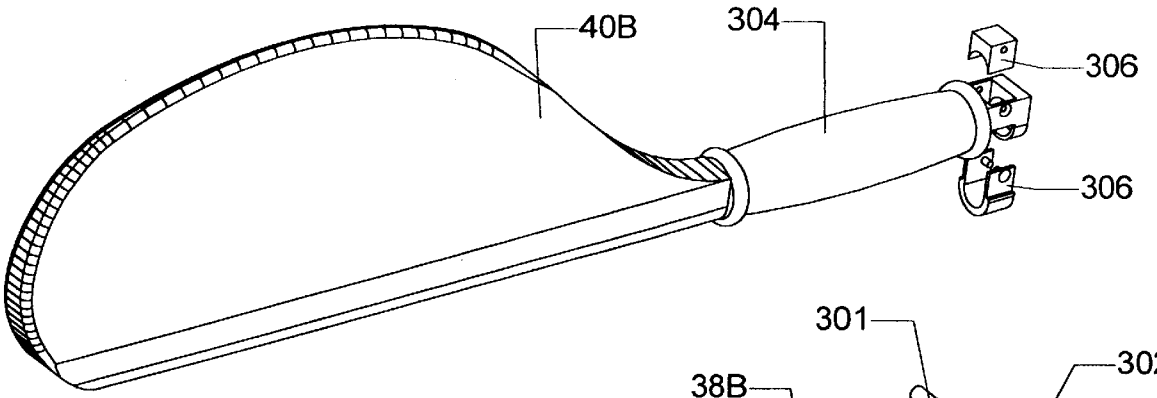
FIG. 18 is a perspective view of a handle and a blade of an aquatic propulsion device according to a further embodiment of the invention.
Figure 19A:
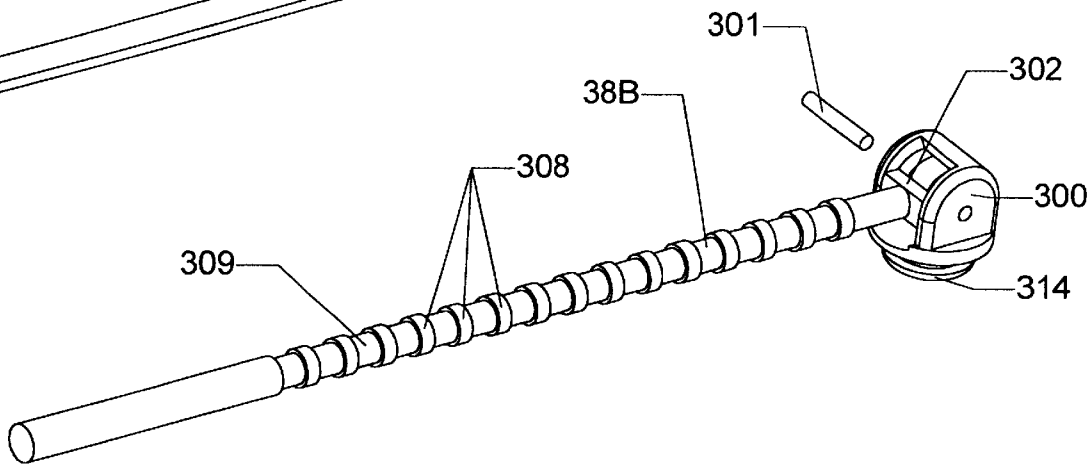
FIG. 19A is a perspective view of first and second pivoting members and an elongate shaft for use with the components shown in FIG. 18.
Figure 19B:
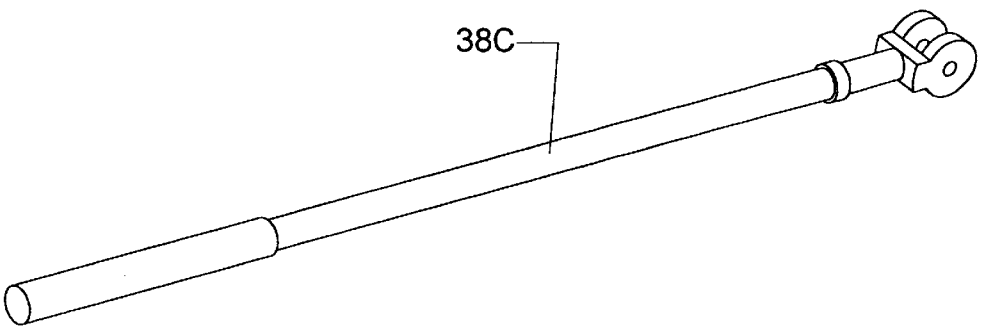
FIG. 19B is a perspective view of an elongate shaft that can be used instead of the elongate shaft in FIG. 19A.

In the embodiments hereinbefore described a ball-and-socket assembly is used which allows for all degrees of freedom of movement of a paddle. It should be understood that alternative arrangements may provide some or all degrees of freedom of movement of a paddle. For example, FIG. 18, FIG. 19A and FIG. 19B illustrate an example wherein separate components allow for different degrees of freedom of movement. In the embodiment shown in FIG. 18 and FIG. 19, a first pivoting member 300 and a second pivoting member 302 are provided. The second pivoting member 302 is pivotally secured to the first pivoting member 300 by a fastener such as a screw or bolt 301. An elongate shaft 38B has one end that is secured to the second pivoting member 302. An opposing end of the elongate shaft 38B is insertable into a handle 304 and from the handle 304 into a paddle 40B which is secured to the handle 304. The paddle 40B cannot rotate relative to the handle 304 but the handle 304 and the paddle 40B can rotate in unison about an elongate axis of the elongate shaft 38B. Locking formations 306 are provided which are securable to the handle 304. A series of circular ribs 308 and recesses 309 are formed on an outer surface of the elongate shaft 38B with which the locking formations 306 engage to select a position of the handle 304 and the paddle 40B along a length of the elongate shaft 38B. An elongate shaft 38C may be provided for dynamic adjustment. The elongate shaft 38C is substantially the same as elongate shaft 38B except the removal of the raised ribs 308, thereby allowing dynamic adjustment of handle 304 and paddle 40B along a restricted length of elongate shaft 38C even when the locking formations 306 are secured to the handle 304. The locking formations 306 prevent the handle 304 from falling off the elongate shaft 38C.

Figure 20:
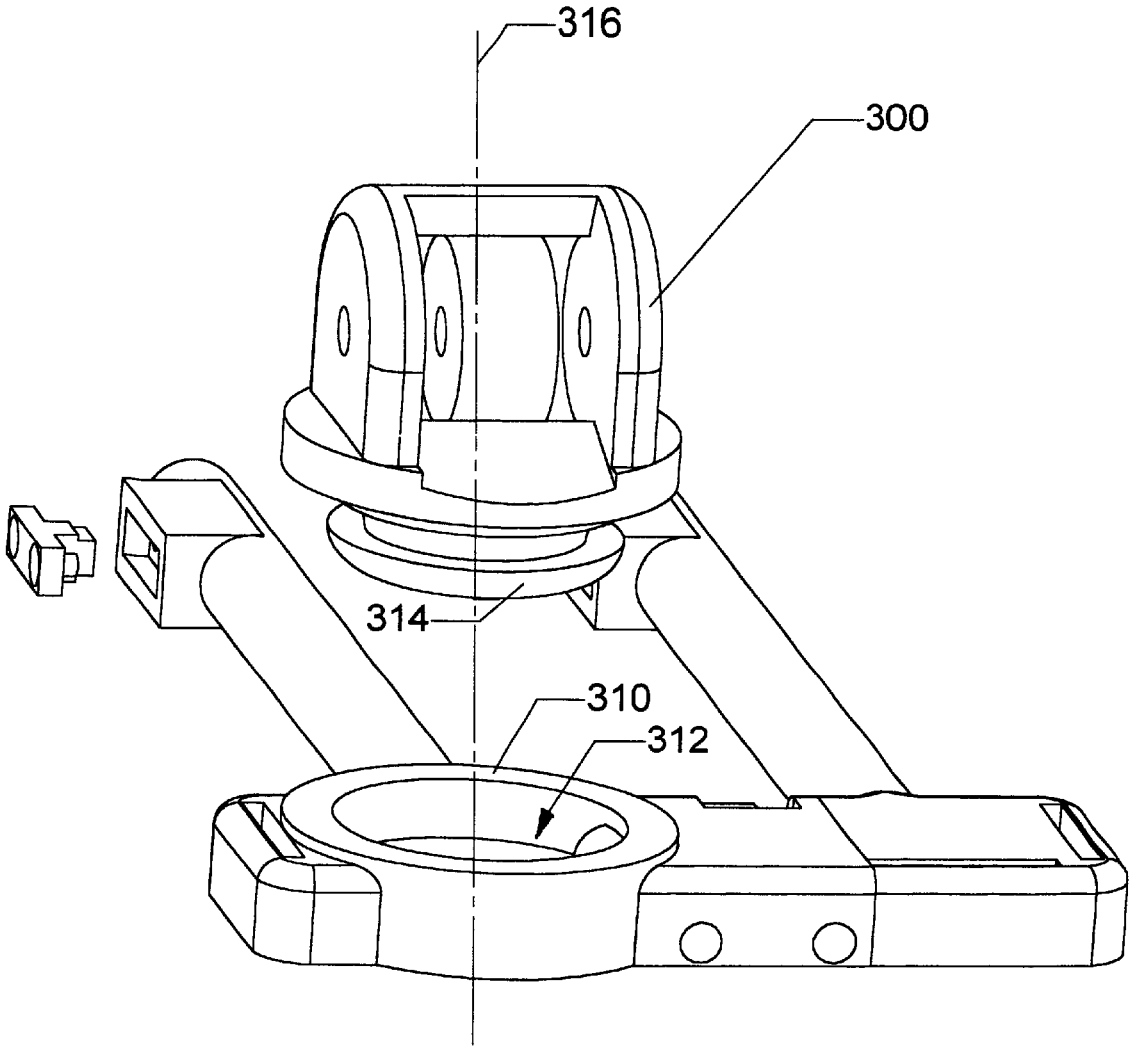
FIG. 20 is a perspective view illustrating a portion of a rigid chest structure for se with the components shown in FIG. 18 and FIG. 19A or 19B.

FIG. 20 illustrates part of a rigid chest structure 36 which has an alternative socket receiving portion 310. The socket receiving portion 310 has a circular opening 312 therein. The first pivoting member 300 shown in FIG. 9 has a circular plug component 314 which is insertable into the opening 312 and securable thereto. The interengagement of the plug component 314 with the opening 312 allows for rotation of the first pivoting member 300 about an axis 316 extending into the opening 312. Such rotation results in rotation of the paddle 40B about a horizontal axis when a person is located in a vertical position. Pivoting of the second pivoting member 302 results in movement of the paddle 40B in a direction towards or away from the horizontal axis. Rotation of the handle 304 about the elongate shaft 38B causes rotation of the paddle 40B about the elongate shaft 38B.

Figure 21:
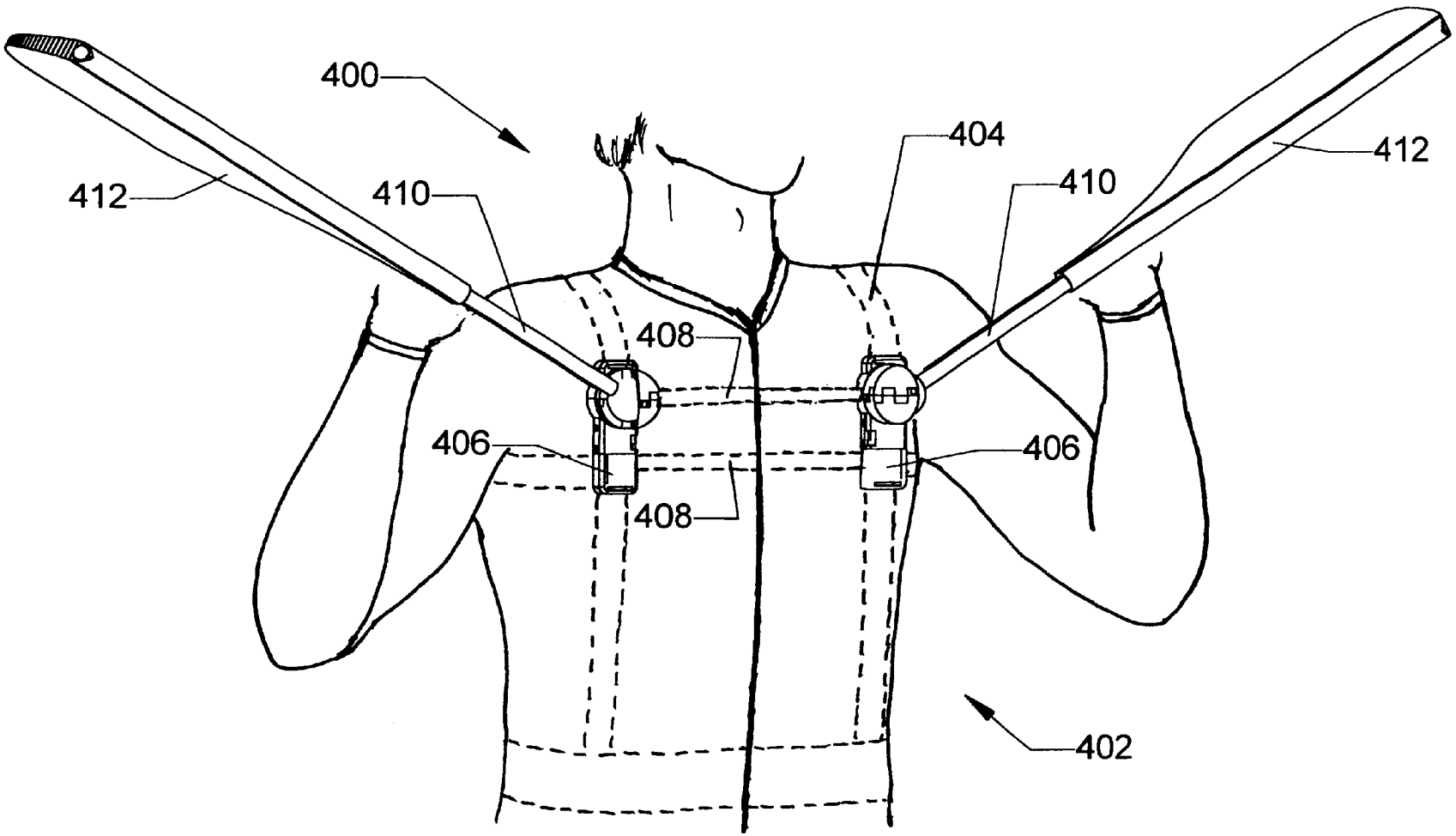
FIG. 21 is a front view of an aquatic propulsion device according to a further embodiment of the invention wherein a harness is secured to a diving suit.

FIG. 21 illustrates an aquatic propulsion device 400 which is the same as the aquatic propulsion device of FIG. 1 except that a diving suit 402 is also provided. A harness 404 is secured within a body portion of the diving suite 402. The harness 404 may be secured to the diving suit 402 utilizing glue, by means of stitching or otherwise. Openings are formed in the body portion of the diving suit 402 through which harness mounts 406 of a rigid chest structure protrude. Upper and lower links 408 of the rigid chest structure are located within the diving suit 402. Elongate shafts 410 and paddles 412 are secured to the harness mounts 406 as hereinbefore described. An advantage of the aquatic propulsion device 400 is that straps of the harness 400 are not located in positions wherein they can catch onto objects. The straps are also located out of way so as not to hinder propulsion through water. A person can also remove the elongate shafts 410 from the harness mounts 406 which allows her to move around unencumbered such as when a person is only wearing a diving suit.

Figure 22:
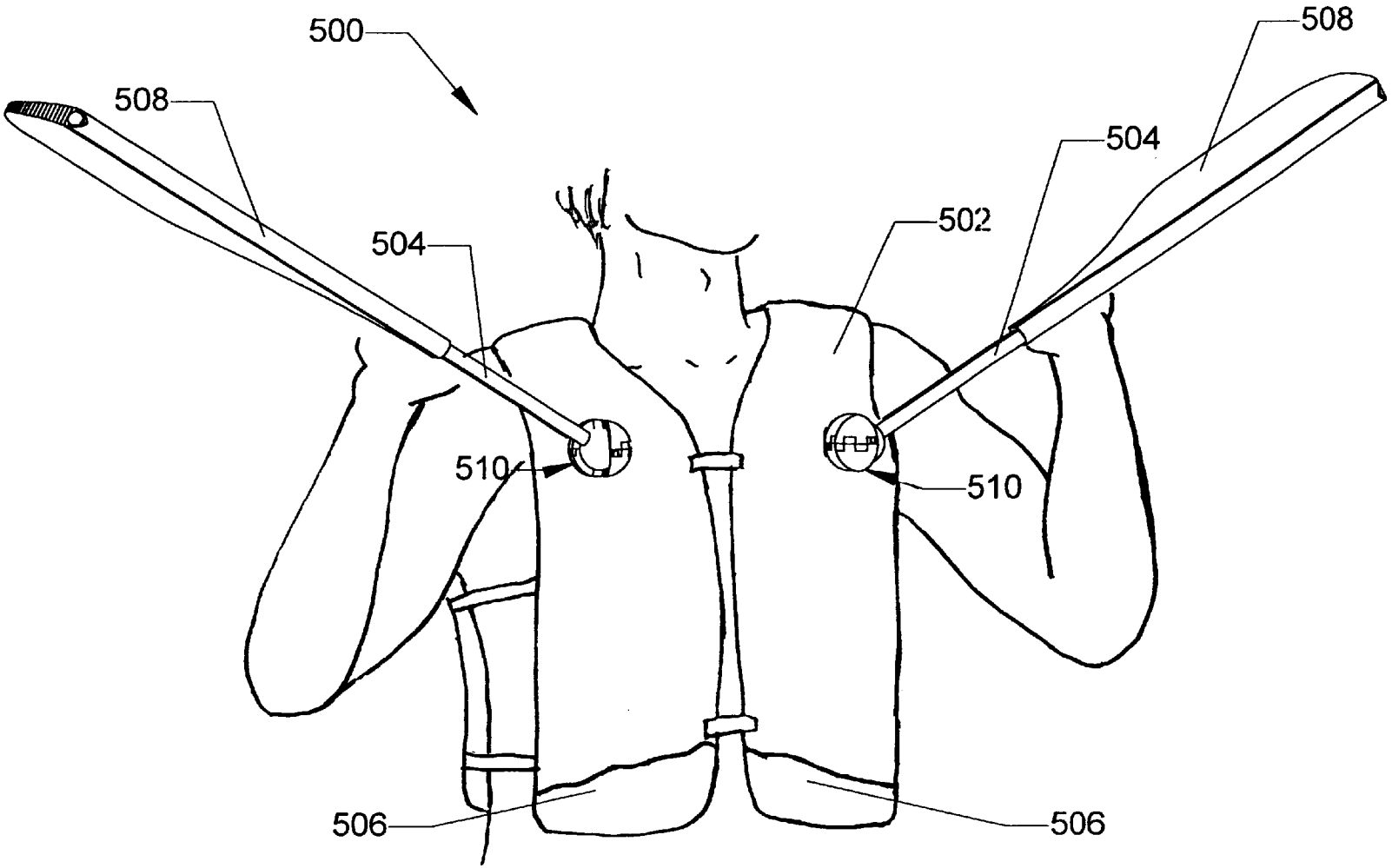
FIG. 22 is a front view of an aquatic propulsion device according to yet a further embodiment of the invention wherein a harness is provided in the form of a life jacket.

FIG. 22 illustrates another embodiment of an aquatic propulsion device 500. The aquatic propulsion device 500 has a harness in the form of a life jacket 502. Elongate shafts 504 are permanently secured to the life jacket 502 utilizing ball-and-socket mounts 510. Pockets 506 are provided near a lower periphery of the life jacket 502. Paddles 508 can be moved away from and closer towards the life jacket 502. In their retracted positions, the paddles 508 can be located within the pockets 506. A person would wear the aquatic propulsion device 500 in a situation wherein the person may accidentally fall into water. The person would still be able to move around unencumbered because the paddles 508 are located within the pockets 506. In the event that the person does fall into the water, the life jacket 502 would allow the necessary floatation for keeping the person buoyant. The person can then remove the paddles 508 from the pockets 506, extend the paddles 508 away from the life jacket 502, and utilize the paddles 508 for propulsion to shore. The aquatic propulsion device 500 thus provides a dual purpose, namely that of providing buoyancy and that of providing propulsion, in a single device. Auxiliary devices such as foot flippers or hand paddles are thus are not required for propulsion to shore in an emergency situation.

While certain exemplary embodiments have been described and shown in the accompanying drawings, it is to be understood that such embodiments are merely illustrative and not restrictive of the current invention, and that this invention is not restricted to the specific constructions and arrangements shown and described since modifications may occur to those ordinarily skilled in the art.

What is claimed:

1. An aquatic propulsion device comprising:

a harness to be worn on the body of a person;

a first elongate member having first and second opposed ends, the first end of the first elongate member being pivotally securable to the harness;

a first paddle secured to the second end of the first elongate member, a combination of the first elongate member and the first paddle having a first grip positioned so that a person, when wearing the harness, can reach and hold onto the first grip with a first hand and move the first grip with the first hand so that the first elongate member and the first paddle pivot relative to the harness;

a second elongate member having first and second opposed ends, the first end of the second elongate member being pivotally securable to the harness; and a second paddle secured to the second end of the second elongate member, a combination of the second elongate member and the second paddle having a second grip positioned so that a person, when wearing the harness, can reach and hold onto the second grip with a second hand and move the second grip with the second hand so that the second elongate member and the second paddle pivot relative to the harness independent of the first elongate member.

2. The aquatic propulsion device of claim 1, further comprising:

a first harness mount secured to the harness, the first elongate member being pivotally secured to the first harness mount;

a second harness mount secured to the harness at a location that is spaced from the first harness mount, the second elongate member being pivotally secured to the second harness mount; and a rigidifying link having one end at the first harness mount and a second, opposing end at the second harness mount, the harness mounts being secured to the link and the link being sufficiently rigid to substantially prevent pivoting of the harness mounts relative to one another.

3. The aquatic propulsion device of claim 2 wherein the spacing between the harness mounts is adjustable.

4. The aquatic propulsion device of claim 1 further comprising:

at least a first harness mount, having a first key formation, secured to the harness; and at least a first elongate member mount having a second key formation, secured to the first elongate member, the first elongate member mount being releasably securably to the first harness mount, the first and second key formations allowing for the first elongate member mount to be secured to the first harness mount when the first elongate member mount is at a selected orientation relative to the first harness mount and preventing the first elongate member mount from being secured to the first harness mount when the first elongate member is rotated out of the selected orientation relative to the first harness mount.

5. The aquatic propulsion device of claim 4 wherein the first and second key formations prevent the first elongate member mount from being secured to the first harness mount when the first elongate member is rotated out of the selected orientation relative to the first harness mount by substantially 180°.

6. The aquatic propulsion device of claim 1 wherein the first elongate member has a first handle formation thereon the first grip being on the handle formation.

7. The aquatic propulsion device of claim 6 wherein the first grip is formed by raised and recessed formations on the handle, the raised and recessed formations substantially conforming to recessed and raised formations, respectively, on a palm of the first hand of the person when holding onto the first grip.

8. The aquatic propulsion device of claim 1 wherein the first paddle is adjustable towards and away from the harness.

9. The aquatic propulsion device of claim 8 wherein the first elongate member includes:

a first component having first and second ends, the first end being pivotally secured to the harness and the second end being located distant from the harness; and a second component secured to the first component, the second component having a first end next to the first component and a second end remote from the first component, the first paddle being secured to the second end of the second component, wherein the second component is adjustable relative to the first component to move the second end of the second component towards or away from the harness.

10. The aquatic propulsion device of claim 9 wherein the second component is slidably adjustable relative to the first component.

11. The aquatic propulsion device of claim 10 wherein adjustment of the second component relative to the first component is unrestricted.

12. The aquatic propulsion device of claim 10 wherein the elongate member includes:

a locking component which is movable between locking and unlocked positions, in the unlocked position allowing for adjustment of the second component relative to the first component and in the locked position securing the second component to the first component so as to prevent adjustment of the second component relative to the first component, the locking component being capable of securing the second component to the first component in a plurality of different positions wherein the first paddle is at a plurality of different distances from the harness.

13. The aquatic propulsion device of claim 1 further comprising:

a socket; and a ball, one of the ball and the socket being secured to the harness and the other being secured to the elongate member, the ball being held captive within the socket so that the combination of the ball and the socket allows for pivoting of the first elongate member relative to the harness in a least two pivoting directions which are transverse to one another and rotation of one first elongate member relative to the harness about an axis extending in an elongate direction of the first elongate member.

14. The aquatic propulsion device of claim 1 further comprising:

a first pivoting member secured to the harness for first pivotal movement; and a second pivoting member secured to the first pivoting member for second pivotal movement, the first elongate member being secured to the second pivoting member, the first pivotal movement allowing for pivoting movement of the first elongate member in a first direction and the second pivotal movement allowing pivoting of the first elongate member in a second directed which is transverse to the first direction.

15. The aquatic propulsion device of claim 1 further comprising at least a first retainer secured to the harness, the first elongate member and the first paddle being movable into a position wherein the first elongate member extends along a length of the body and the retainer being positioned to secure the first elongate member and the first paddle in such a position.

16. The aquatic propulsion device of claim 1 wherein the person can move the first grip so that the first paddle moves in an orbital path wherein the first paddles moves over a surface of water during a section of the orbital path and returns through the water during another section of the orbital path to propel the person relative to the water.

17. The aquatic propulsion device of claim 16 wherein the body of the person is positioned substantially horizontally in the water and the person is propelled along a length of the person.

18. The aquatic propulsion device of claim 1 wherein the person, when positioned substantially horizontally in water, can move the first grip so that the first paddle is moved back and forth substantially along a length of the person, the first paddle being rotatable about any axis extending in an elongate direction of the first elongate member so that the person is propelled through the water along a length of the person following one complete back-and-forth cycle of the first paddle through the water.

19. The aquatic propulsion device of claim 1 wherein the person, when positioned substantially horizontally in water, can move the first grip so that the paddle is moved back and forth between two vertically spaced depths in the water, the paddle being rotatable about an axis extending in an elongate direction of the first elongate member so that the person is propelled along a length of the person following one complete back-and-forth cycle of the first paddle.

20. The aquatic propulsion device of claim 1 wherein the harness is of a life jacket to be worn by the person and providing buoyancy to the person when in water.

21. The aquatic propulsion device of claim 1 further comprising a diving suit having a body portion to be worn by the person, the harness being secured to the diving suit.

* * * * *